US007584569B2

(12) United States Patent
Kallio et al.

(10) Patent No.: US 7,584,569 B2
(45) Date of Patent: Sep. 8, 2009

(54) TARGET ILLUMINATING ASSEMBLY HAVING INTEGRATED MAGAZINE TUBE AND BARREL CLAMP WITH LASER SIGHT

(75) Inventors: Robert A Kallio, Conesus, NY (US); Jeffrey S. Wolinski, Perry, NY (US); Michael W. Allen, Shortsville, NY (US); Robert J. Kolbet, Macedon, NY (US); William R. Houde-Walter, Rush, NY (US)

(73) Assignee: LaserMax, Inc., Rochester, NY (US)

( * ) Notice: Subject to any disclaimer, the term of this patent is extended or adjusted under 35 U.S.C. 154(b) by 126 days.

(21) Appl. No.: 11/207,418

(22) Filed: Aug. 19, 2005

(65) Prior Publication Data

US 2007/0039225 A1 Feb. 22, 2007

(51) Int. Cl.
*F41G 1/35* (2006.01)

(52) U.S. Cl. ..... 42/117; 42/124

(58) Field of Classification Search ..... 42/90, 42/113, 114, 117, 123, 124, 131, 132
See application file for complete search history.

(56) References Cited

U.S. PATENT DOCUMENTS 1,260,021 A * 3/1918 Otterson ..... 42/86
3,112,645 A * 12/1963 Glass ..... 73/170.04
3,445,951 A * 5/1969 Dahl et al. ..... 42/86
4,662,845 A 5/1987 Gallagher et al.
4,697,226 A * 9/1987 Verdin ..... 362/110
4,856,218 A * 8/1989 Reynolds, Jr. ..... 42/146
4,934,086 A * 6/1990 Houde-Walter ..... 42/115
5,584,137 A * 12/1996 Teetzel ..... 42/117
5,727,346 A * 3/1998 Lazzarini et al. ..... 42/146
6,023,875 A * 2/2000 Fell et al. ..... 42/146
6,142,650 A 11/2000 Brown et al.
6,381,895 B1 * 5/2002 Keeney et al. ..... 42/124
6,397,509 B1 * 6/2002 Langner ..... 42/116
6,431,732 B1 8/2002 Brown et al.
6,508,027 B1 * 1/2003 Kim ..... 42/124
6,616,301 B2 9/2003 Brown et al.
6,655,069 B2 * 12/2003 Kim ..... 42/114
6,722,076 B2 * 4/2004 Nielsen ..... 42/146
6,799,868 B2 10/2004 Brown et al.
7,100,602 B2 * 9/2006 Cole et al. ..... 128/200.14
7,117,624 B2 * 10/2006 Kim ..... 42/85
7,134,234 B1 * 11/2006 Makarounis ..... 42/146

(Continued)

*Primary Examiner*—Michael Carone
*Assistant Examiner*—Jonathan C Weber
(74) *Attorney, Agent, or Firm*—Brian B. Shaw, Esq.; Stephen B. Salai, Esq.; Harter Secrest & Emery LLP

(57) ABSTRACT

A magazine tube and barrel clamp with integral target illuminator, wherein a laser module can be incorporated is provided for a firearm having a magazine tube and a barrel. The frame defines a clamping sleeve for substantially encircling the magazine tube and a barrel receiving channel for receiving a diameter of the barrel, wherein the magazine tube and the barrel are thus fixed in a predetermined spacing. The frame further defines an illuminator recess for receiving a substantial portion of a reflector in the target illuminator, thereby shielding the target illuminator from contact with external surfaces. A driver circuit is retained within the frame to selectively operate the target illuminator and a laser sight, wherein the target illuminator can be a solid-state light emitting device.

18 Claims, 9 Drawing Sheets

U.S. PATENT DOCUMENTS

| | | | | |
|---|---|---|---|---|
| 7,188,978 | B2 * | 3/2007 | Sharrah et al. | 362/396 |
| 7,226,183 | B2 * | 6/2007 | Galli et al. | 362/191 |
| 2003/0106251 | A1 * | 6/2003 | Kim | 42/71.01 |
| 2004/0045209 | A1 * | 3/2004 | Nielsen | 42/146 |
| 2005/0217161 | A1 * | 10/2005 | Haugen et al. | 42/124 |
| 2007/0137087 | A1 * | 6/2007 | Florea et al. | 42/90 |
| 2007/0245616 | A1 * | 10/2007 | Schiller et al. | 42/123 |
| 2007/0277422 | A1 * | 12/2007 | Ding | 42/146 |
| 2008/0060248 | A1 * | 3/2008 | Pine et al. | 42/114 |

* cited by examiner

FIGURE 10
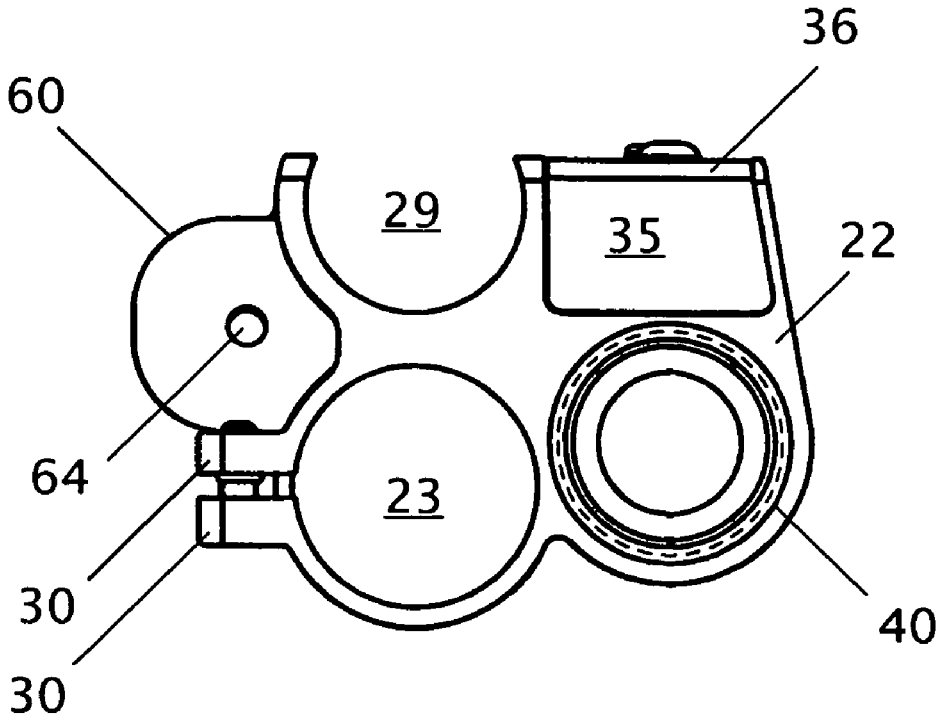
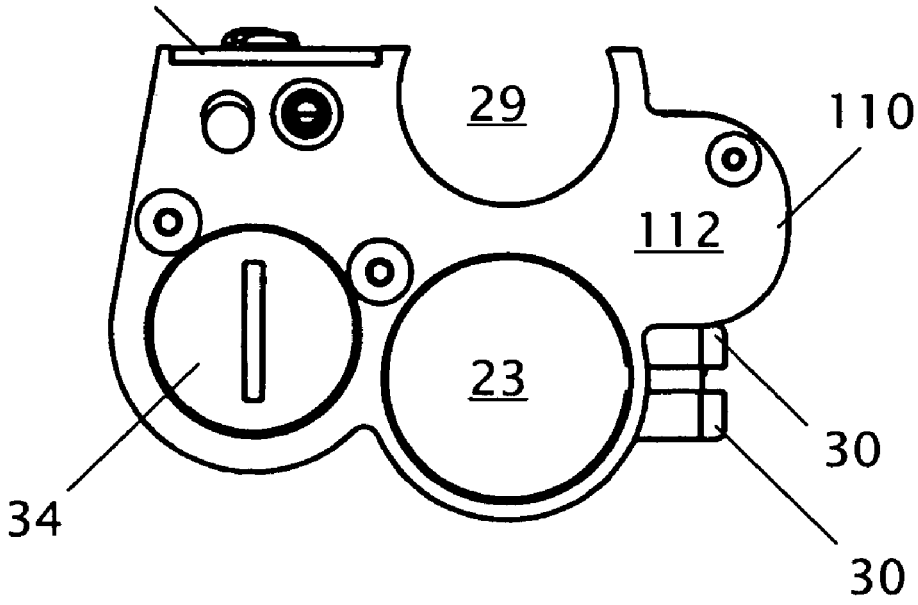
FIGURE 11

TARGET ILLUMINATING ASSEMBLY HAVING INTEGRATED MAGAZINE TUBE AND BARREL CLAMP WITH LASER SIGHT

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present invention relates to target illuminators and laser sights incorporated into a magazine tube and barrel clamp, wherein an original capacity of the magazine is maintained.

2. Description of Related Art

Law enforcement and military organizations often find it necessary to perform armed operations in darkness or low-light conditions. To ensure that their mission is carried out properly, successfully and safely, the operational personnel often employ flashlights to illuminate a potential target in the event use of a weapon becomes necessary. However, it is awkward and restrictive to hold a flashlight in one hand and a weapon in the other. Consequently, flashlight attachments to weapons have been developed, wherein a flashlight is actually mounted on the weapon, pointing the same direction as the barrel of the weapon, so that a potential target can be illuminated by pointing the weapon generally in the direction of the target with one hand, leaving the other hand free. Ordinarily, such devices provide for the flashlight to be removably mounted on the weapon so that it does not limit weapon flexibility when the flashlight is not needed.

Various devices have been developed for removably mounting a flashlight on a weapon. For example, Sharrah et al. U.S. Pat. No. 5,628,555; Christiansen U.S. Pat. No. 5,816,683; and Fell et al. U.S. Pat. No. 6,023,875 all disclose devices for attachment of a flashlight to the bottom of the handgrip of a handgun. However, these devices can interfere with gripping the handgun, render holstering the handgun difficult, and require either that the flashlight be switched on, or actuated, with a hand other than the gripping hand or by a dedicated switch disposed on the handgrip.

It is now common in law enforcement and certain military operations for weapons to be equipped with a laser sighting device, that is, a laser mounted on the weapon that propagates a relatively narrow, intense laser light beam to a target so as to produce a spot on the target essentially where the projectile will intercept the target if the weapon is discharged. This enables the weapon to be aimed precisely by pointing the weapon so that the spot lies on the target at the point where the person using the weapon wants the projectile to strike the target. Such a laser sighting device is disclosed, for example, in Toole et al. U.S. Pat. No. 5,435,091.

While a laser sighting device provides an aiming function, it does not provide an illuminating function. Consequently, it is often desirable to equip a weapon with both a laser sight and a target illuminator, such as a flashlight attachment. Both of these types of devices require electrical power.

Other flashlight attachment devices have been designed for mounting either on the barrel of a rifle or under the barrel and frame of a handgun. In the case of a handgun, the flashlight is typically attached to a forward portion of the handgun frame. A device of this type is shown by Teetzel U.S. Pat. No. 5,685,105. In Teetzel, a flashlight is removably mounted on a laser sighting device that is attached under the barrel and frame of a weapon, and the flashlight attachment can be actuated simultaneously with the laser sighting device by an infrared light source in the sighting device coupled to the flashlight attachment. However, a drawback to this approach is that a physical connection between the handgrip and the front part of the frame of the weapon is required to switch the laser and flashlight on from the handgrip. Such a connection, whether by electrical wiring, optical waveguide, or mechanical link adds weight, may require undue modification of the weapon, and can be inconvenient.

Therefore, a need remains for a target illuminator that cooperatively engages the firearm, without reducing capacity of the firearm. The need also exists for a combined target illuminator and laser sight assembly that can be readily attached to the firearm, without significantly increasing the footprint of the firearm. A further need exists for controlling the target illuminator and laser sight so as to capture the available performance of both the target illuminator and the laser sight. A need also exists for a laser sight assembly that can be quickly coupled to the firearm without impeding the functionality of the firearm, and further wherein the assembly increases at least a local structural integrity of the firearm.

BRIEF SUMMARY OF THE INVENTION

The present invention provides a target illuminating assembly having an integrated magazine tube and barrel clamp with a laser sight, wherein capacity of the firearm magazine is not reduced.

In one configuration, a target illuminating assembly for a firearm is provided, wherein the assembly includes a frame having a front end and a rear end, the frame including (i) a clamping sleeve substantially encircling the magazine tube, (ii) an illuminator recess in the front end of the frame, (iii) a power source cavity and (iv) a barrel receiving channel; a target illuminator within the illuminator recess, the target illuminator including a reflector, a majority of the reflector located within the illuminator recess; and a driver circuit connected to the target illuminator.

In a further configuration, a laser module can be incorporated into or connected to the frame and operably connected to the driver circuit for selective operation in at least one of a continuous or pulsed mode.

Further, the frame can be configured to substantially encircle the magazine tube and at least encompass a diameter of the barrel thereby fixing the relative positions of the barrel and the magazine tube.

In one configuration, the driver circuit provides a pulsed laser sight with a simultaneous constant illumination from the target illuminator. That is, the driver circuit can provide anti-flicker illumination from the target illuminator independent of operation of the laser sight. Alternatively, the driver circuit can pulse the target illuminator at a frequency, including a frequency different from the laser pulse.

In a further configuration, the target illuminator can be used to temporarily blind or disorient a target. For example, the target illuminator can have a sufficient brightness combined with a pulse or flash rate to provide a non lethal weapon with respect to the target such as by dazing or dazzling the target so as to impart temporary flash blindness, or disorientation.

It is further contemplated that each of a plurality of firearms can include a corresponding target illuminating assembly (with or without a laser module), wherein actuation of the respective target illuminator of the separate firearms can be coordinated (such as in a symmetric or asymmetric pattern) to assist in subduing the target. Depending upon the number of target illuminating assemblies, the coordinated illumination can be any of a variety of patterns, such as sequential, grouped or simultaneous to assist the officers.

BRIEF DESCRIPTION OF THE SEVERAL VIEWS OF THE DRAWING(S)

FIG. 10 is a front end elevational view of the integrated clamp and target illuminator.

FIG. 11 is a rear end elevational view of the integrated clamp and target illuminator.

DETAILED DESCRIPTION OF THE INVENTION

Figure 1:
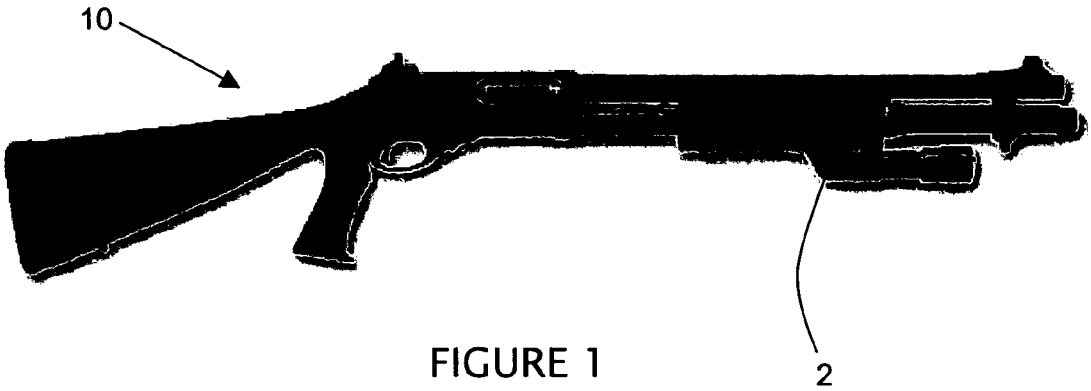
FIG. 1 is a side elevational view of a prior art target illuminator attached to a shotgun.
Figure 2:
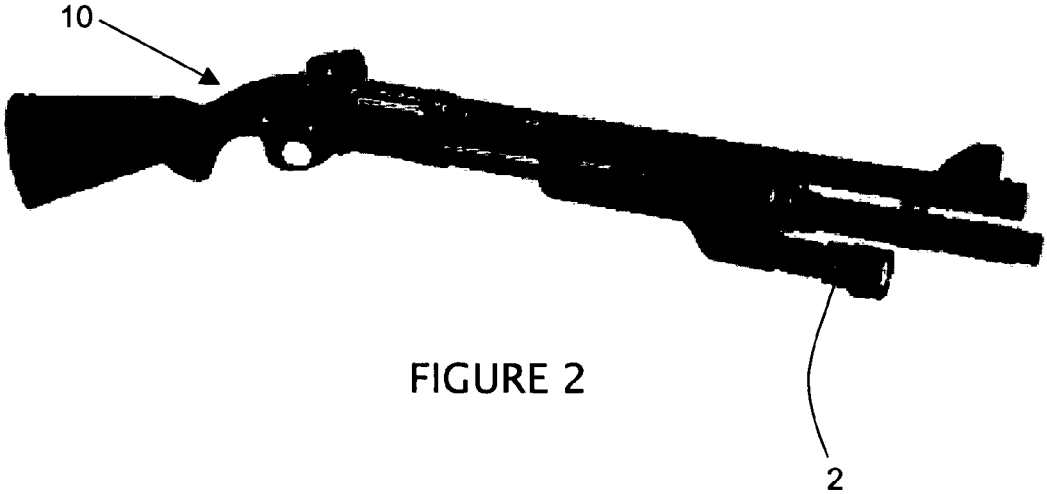
FIG. 2 is a perspective view of a prior art target illuminator attached to an alternative shotgun.

Referring to FIGS. 1 and 2, a prior art target illuminator 2 is shown connected to a firearm 10.

The term firearm 10 is intended to encompass any of a variety of firearms, including but not limited to shotguns, rifles, long guns and shoulder guns. In a preferred construction, the firearm 10 includes an elongate barrel and a generally parallel magazine tube.

The prior art target illuminator 2 connects to a magazine tube and suspends flashlight beneath the magazine tube.

Figure 3:
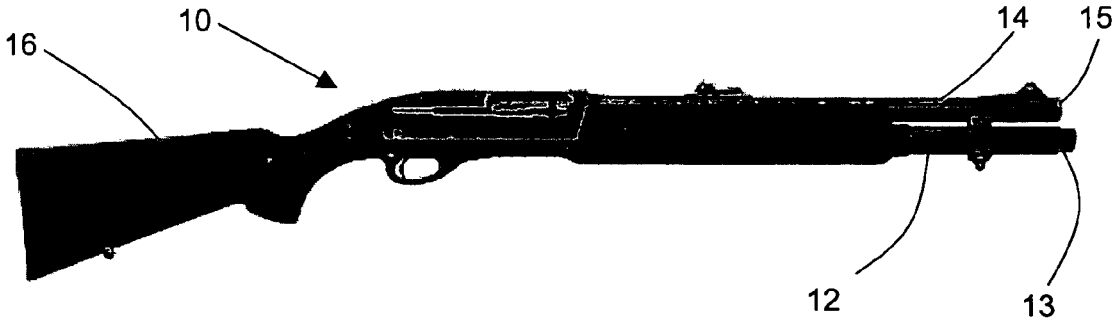
FIG. 3 is a side elevational view of a firearm, such as a shotgun to which the present integrated clamp and target illuminator connects.

Referring to FIG. 3, in relevant part the firearm 10 includes a barrel 14, a stock 16 and the magazine tube 12. Typically, the barrel 14 and the magazine tube 12 are generally parallel, wherein the barrel terminates at a forward end 15 and the magazine tube terminates at a corresponding forward end 13 which is slightly spaced from the end of the barrel. The remaining components of the firearm 10 are well known in the art and not included in this description.

An integrated magazine tube and barrel clamp with target illuminator 20 and laser sight is provided for cooperatively engaging the firearm 10. In one configuration, the present device 20 can include the integrated magazine tube and barrel clamp with a target illuminator, wherein the laser sight is an optional component. For purposes of description, the target illuminating assembly 20 is referred to as including the integrated magazine tube and barrel clamp with target illuminator wherein a laser module 60, can be incorporated as desired. However, it is understood the target illuminating assembly 20 is not limited to the specific configuration of the barrel clamp or the magazine tube.

It is recognized, that in literal terms the laser module illuminates the target. However, the target illuminator 40 illuminates an area many times greater than a cross section of the illumination beam as the beam exits the target illuminator. That is, the target illumination is provided by an intentionally diverging beam. In contrast, the laser sight can be a coherent beam which does not materially diverge upon passing from the laser module 60 to the target.

Figure 4:
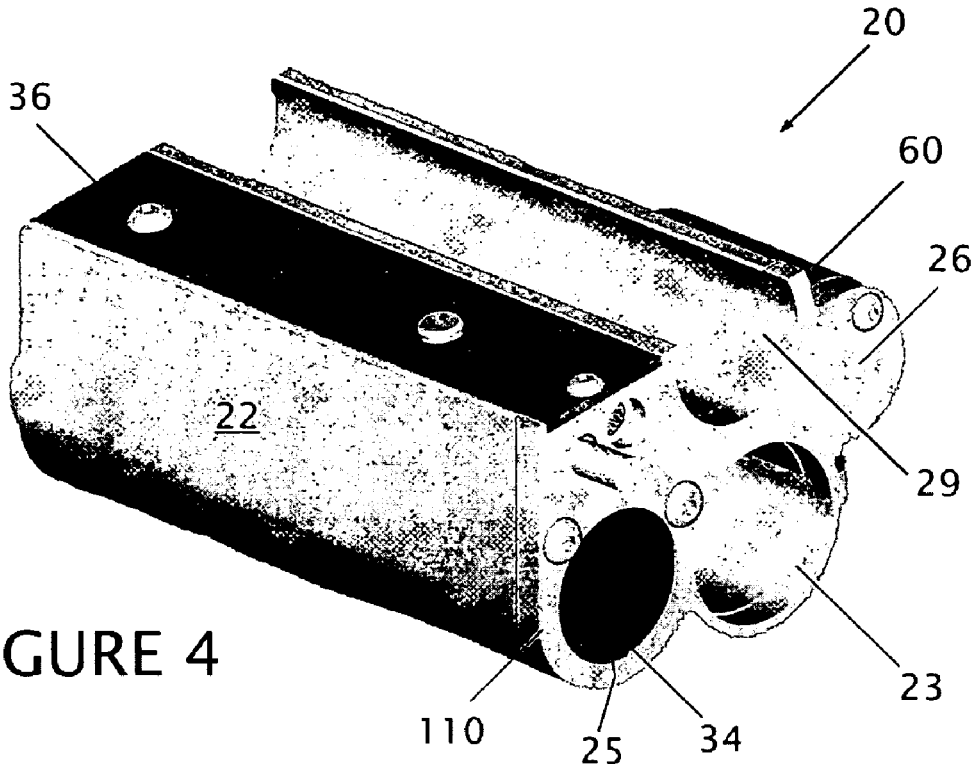
FIG. 4 is a left side rear perspective view of the integrated clamp and target illuminator.
Figure 5:
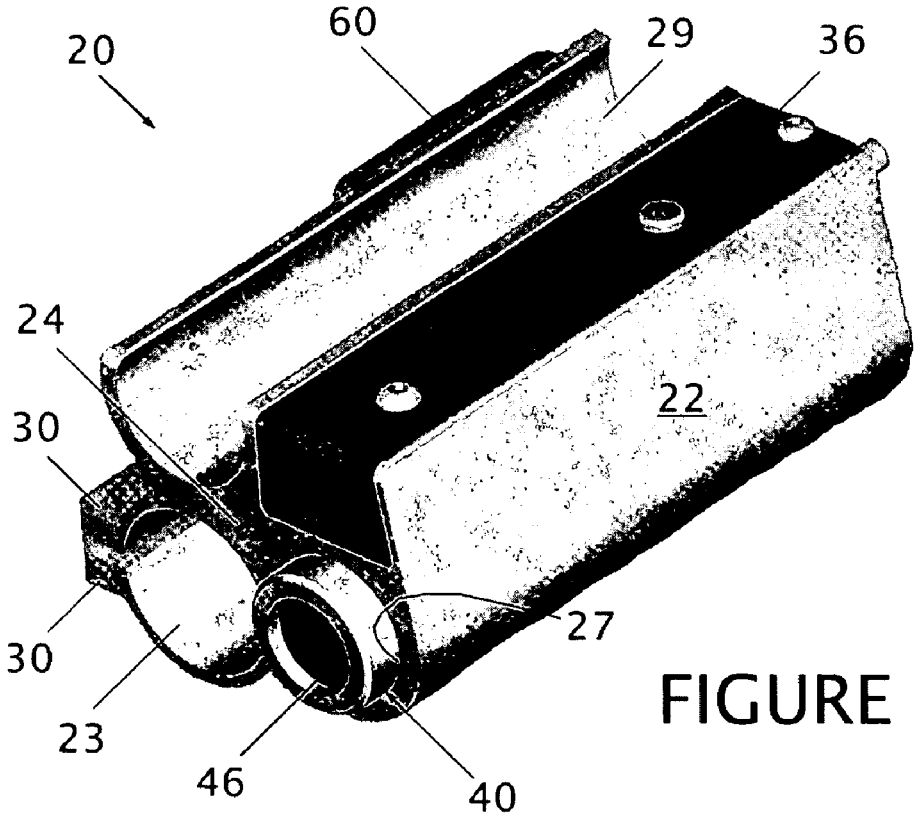
FIG. 5 is a left side front perspective view of the integrated clamp and target illuminator.
Figure 6:
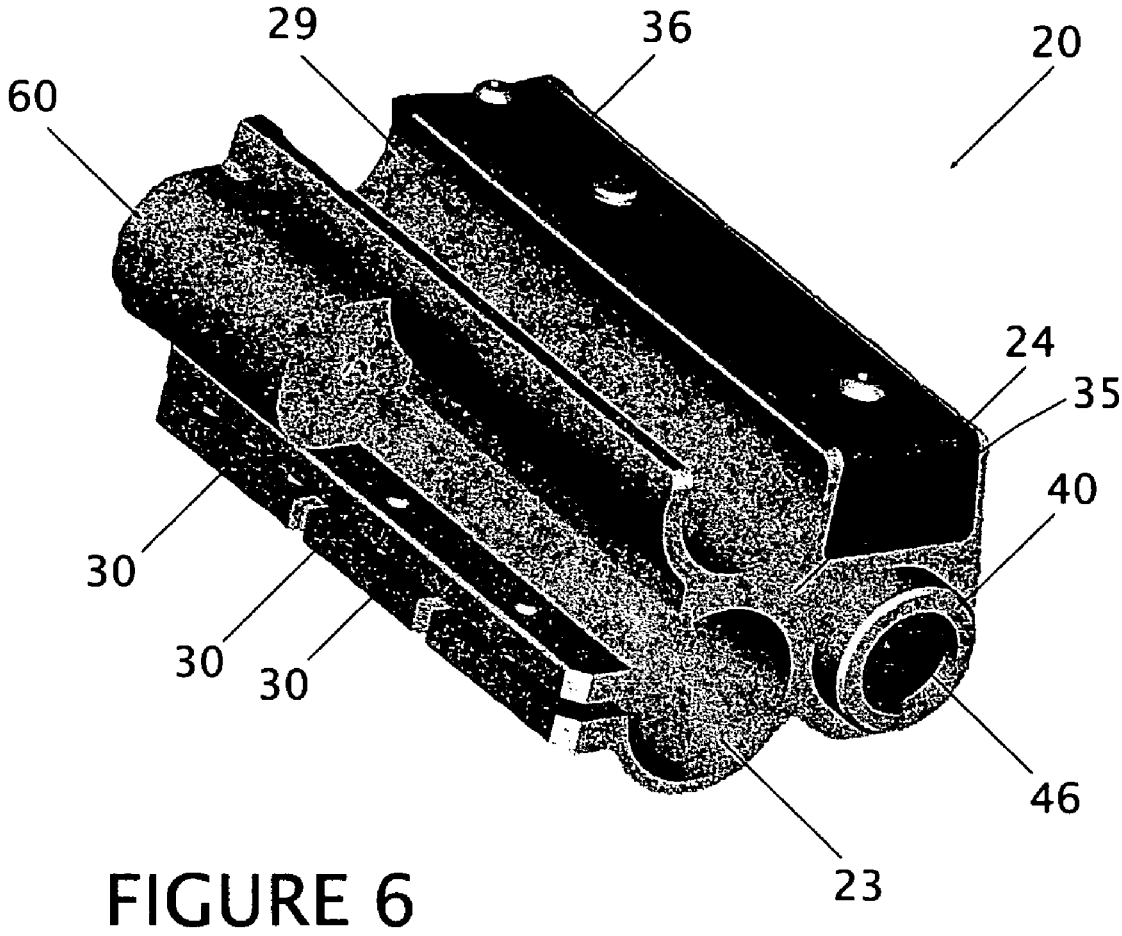
FIG. 6 is a right side front perspective view of the integrated clamp and target illuminator.

The target illuminating assembly 20 with the integrated clamp is shown in perspective in FIGS. 4-6. The target illuminating assembly 20 with the integrated clamp includes a frame 22, forming a body of the integrated clamp, the target illuminator 40 and, as desired, the laser module 60.

The frame 22 defines an elongate clamping sleeve 23, a power source cavity 25, an illuminator recess 27 and a barrel receiving channel 29. The frame 22 has a front end 24 adjacent the front end 15 of the barrel 14 and a rear end 26 which extends toward the butt or stock 16 of the firearm 20.

The frame 22 defines a least one of the clamping sleeve 23 and the barrel receiving channel 29 to be at least as long as a diameter of the respective sleeve or channel. In a further configuration, the clamping sleeve 23 and barrel are at least twice as long as their respective diameters, and can be on the order of three times as long.

The clamping sleeve 23 is sized to slidably receive a length of the magazine tube 12. Thus, the clamping sleeve 23 defines an inner diameter which is sufficiently large to receive an outer diameter of the magazine tube 12. As particularly shown in FIG. 6, the frame 22 includes at least one set of spaced clamping flanges 30, wherein a clamping mechanism 32, such as a threaded fastener, a cam, a lever or other mechanical mechanism can be used for selectively varying a spacing between the clamping flanges, and hence changing the inner diameter of the clamping sleeve 23. Thus, the frame 22 can define a housing connected to the firearm 10.

The illuminator recess 27 opens to the front end 24 of the frame 22. The illuminator recess 27 can be any of a variety of configurations, such as defining a cylindrical, a frustoconical, a tapered or a stepped cross section. In one configuration, a rearward portion of the illuminator recess 27 is exposed to the power source cavity 25.

The power source cavity 25 is sized to receive the power source. As seen in FIGS. 4 and 11, the power source cavity 25 opens to the rear end 26 of the frame 22 and is selectively closed by a cavity cap 34. The cavity cap 34 allows the power source cavity 25 to be selectively opened and closed without interfering with the firearm 10, or requiring removal of the frame 22 from the firearm.

The sizing of the power source cavity 25 is at least partially determined by the capacity of a given available battery size. With current battery capacities, one configuration of the target illuminating assembly 20 and integrated clamp (with the laser module 60) employs two AA batteries. However, it is understood that any of a variety of battery configurations can be employed, at least partially determined by intended operating environment and desired interval of operation between battery changes.

Figure 9:
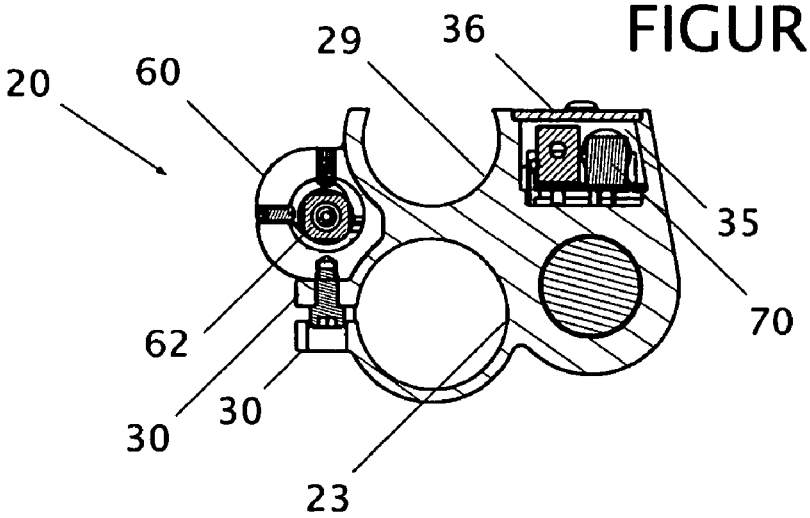
FIG. 9 is a cross sectional view of the integrated clamp and target illuminator taken along lines 9-9 of FIG. 8.

The barrel receiving channel 29 is sized to slidably receive a length of the barrel 14. As seen in FIGS. 9, 10 and 11, the barrel receiving channel 29 encircles at least ¼ (25%), and in one configuration about ⅓ (33%), and in a further configuration at least approximately ½ (50%) of the periphery of the barrel 14. That is, in one configuration, the barrel receiving channel 29 encompasses the (outer) diameter of the barrel 14. The barrel receiving channel 29 can be sized to avoid exerting a clamping or restrictive force on the barrel 14, but rather capture the diameter of the barrel within the channel. Thus, the barrel 14 cannot be removed through the open top portion of the barrel receiving channel 29, but rather must be slid out an end of the barrel receiving channel.

Figure 7:
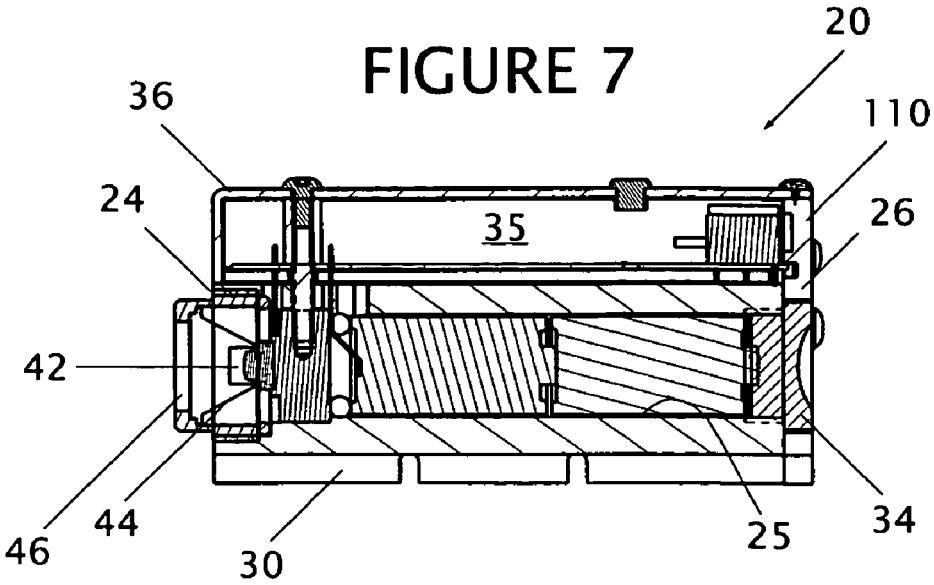
FIG. 7 is a cross sectional view of the integrated clamp and target illuminator taken along a horizontal plane.
Figure 8:
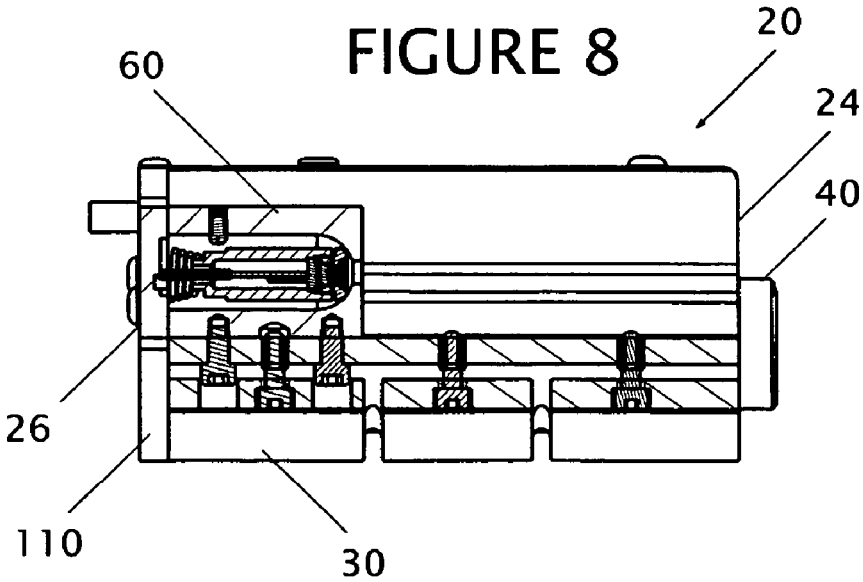
FIG. 8 is a cross sectional view of the integrated clamp and target illuminator taken along a horizontal plane.

Referring to FIGS. 7, 8 and 9, the frame 22 also at least partially defines a controller cavity 35. The controller cavity 35 is sized to receive a controller 50, and a driver circuit 70, wherein the driver circuit is configured to operate the target illuminator 40 as well as the laser module 60. It is understood, a cover 36 can be employed with the frame 22 to enclose or define the controller cavity 35. An advantage of employing the cover 36 in combination with the frame 22 to enclose the controller cavity is that access to the electrical components such as the controller 50 and the driver circuit 70, can be achieved without removing the integrated clamp and target illuminator 20 from the firearm 10. Thus, repairs or upgrades can be readily accomplished without (re)moving the power source, the target illuminator 40 or the laser module 60, as well as allowing the frame 22 to remain affixed to the firearm 10.

The frame 22 can be formed of any of a variety of rigid material such as composites, laminates, plastics or metals. In one configuration, the frame 22 is formed of an extruded aluminum, thereby providing sufficient strength without adding significant weight to the firearm. However, it is understood the frame 22 could also be machined such as by EDM (electrical discharge machining) or molding if composites, laminates, plastics or even metals are employed for the frame.

Figure 12:
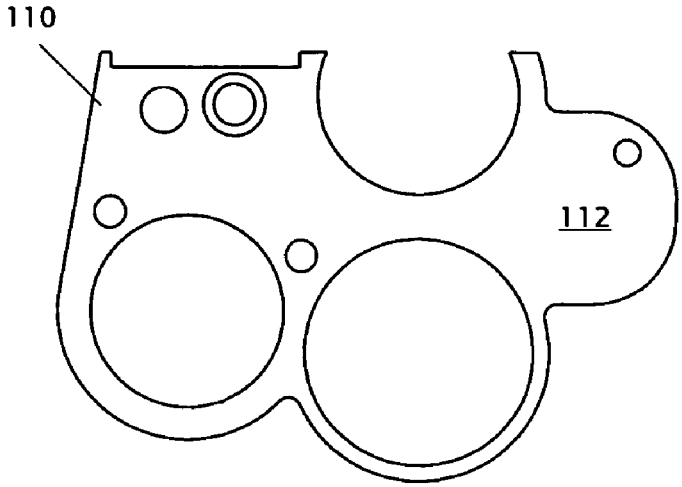
FIG. 12 is an elevational view of a rear end plate.
Figure 13:
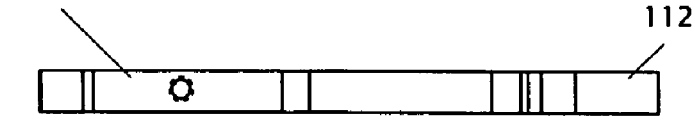
FIG. 13 is a top plan view of the rear end plate of FIG. 12.

As seen in FIGS. 7, 8, 12 and 13, an end plate 110 can operably engage the rear end 26 of the frame 22. Generally, the end plate 110 has a cross sectional profile corresponding to a cross sectional profile of the frame 22. In addition, as seen in FIGS. 12 and 13, the end plate 110 can include a mounting tab 112 for engaging a portion of the laser module 60.

It is also understood the frame 22 can define a laser recess sized to receive the laser module or a laser emitter, wherein the laser recess can be closed with a corresponding laser lens cap 39.

The target illuminator 40 is at least partially disposed within the illuminator recess 27. The target illuminator 40 includes a light emitting element 42 and a reflector 44.

Although any of a variety of light emitting elements 42 can be employed, such as traditional filament, or bulb devices, a preferred light emitting element includes a solid-state device such as a light emitting diode (LED). The use of solid-state light emitting elements reduces the number of moving parts and removes glass, Mercury, gases and filaments from the device. Thus, the solid state device the components are less likely to rupture, shatter, leak or contaminate. It has been found that solid-state light emitting elements, such as LEDs, can provide an average of 70% of an initial intensity after 50,000 hours of operation. The solid-state light emitting elements do not suddenly cease to function, but rather gradually degrade in performance over time. Thus, there is no surprise or sudden loss of illumination which could disadvantage the operator. A satisfactory light emitting element 42 has been found to be an LED sold by Lumileds Lighting of California under the trademark Luxeon.

It is understood that a single solid-state light emitting element or a plurality of such elements can be employed in a variety of arrangements or arrays.

The reflector 44 is configured to direct light emitted from the light emitting element 42 generally parallel to the axis of the barrel 14. While the light emitting elements 42 can be oriented to provide a generally directional light, it is often advantageous to employ a reflector to assist in generating a directed illuminating beam. Depending upon the specific light emitting elements 42 and the desired illumination pattern, the reflector 44 can have any of a variety of configurations including parabolic, bell or conical.

It is also understood the target illuminator 40 can include a lens cap 46 to connect to at least one of the reflector or the frame to protect the light emitting elements. The lens cap 46 can include a transparent window 48 such as plastic or glass, wherein the window may assist in focusing of the beam, or merely be a generally neutral optical element.

In one configuration, a majority of the reflector 44 (and the light emitting element 42) is disposed within the illuminator recess 27. That is, the frame 22 substantially encloses, and hence protects the reflector 44 and the light emitting element 42. In one configuration, at least half, and preferably approximately 75% of the reflector 44 is disposed within the illuminator recess 27. The lens cap 46 can overlay the exposed portion of the reflector 44. Alternatively, if the reflector 44 is at least substantially disposed within the illuminator recess 27 or entirely within the illuminator recess, the lens cap 46 can substantially close the illuminator recess.

In one configuration, the target illuminator 40 is selected to provide sufficiently bright illumination at an anticipated distance of a target, so as to allow for temporary disabling, blinding or disorientation of a human target. That is, the target illuminator 40 can be used to temporarily blind (flash blind—the impairment of vision resulting from an intense flash of light, including temporary or permanent loss of visual functions and may be associated with retinal burns) a human target, or if flashed at a certain to rate, disorient the target to allow the target to be disarmed or disabled, without requiring discharge of the firearm 10. The effect of such light on a human target is often referred to as dazzle—the temporary loss of vision or a temporary reduction in visual acuity.

The laser module 60 is connected to the frame 22 as seen in FIGS. 4-6 and 9, and provides the laser sight. The frame 22 includes a concave surface and the laser module 60 includes a mating convex surface as particularly shown in FIG. 9. The laser module 60 includes a module housing 62 which defines a recess 63 into which a laser 64 is disposed. Typically, the laser 64 is self-contained and includes a lens, such that the laser is operably disposed within the recess of the module housing. However, it is understood a separate laser lens cap can be employed to engage the module housing.

In a further configuration, the laser module 60 can include a hologram 66 located to be in the path of the emitted coherent light from the laser. The hologram 66 can be constructed to provide any of a variety of patterns such as shotgun pattern, or spread pattern. Thus, the hologram 66 when illuminated can define a visual representation of the spread and thereby allows the operator, as well as a target, to readily assess coverage of the shotgun pattern.

Figure 14:
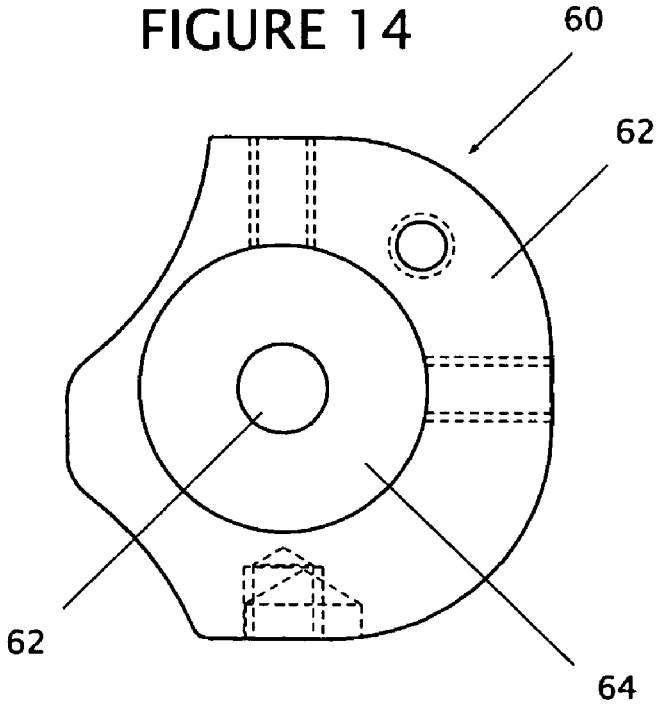
FIG. 14 is an end elevational view of the laser module.

As seen in FIG. 14, the laser module 60 (by means of the module housing 62) defines a cross sectional periphery, wherein a portion of the periphery of the laser module (module housing) mates with a corresponding surface of the frame 22. Further, the mounting tab 112 of the end plate is sized to seat the cross sectional profile of the laser module.

The controller 50 can be any of a variety of microprocessors, either dedicated to the target illuminating assembly 20, or programmed to provide the desired performance characteristics. The controller 50 can be a separate component communicating with the driver circuit 70. Alternatively, the controller 50 and the driver circuit 70 can be combined into a single substantially integral component or processor.

Further, the controller 50 can include, or cooperate with a transceiver 54 for receiving and transmitting data, wherein the data may include instructions or codes. The transceiver 54 can be any and a variety of commercially available transceivers. Alternatively, the transceiver 54 can cooperate with the target illuminator 40 and include a photodiode for sensing a modulation of a proximal target illuminator (LED light 42), wherein data transmission can be accomplished by a rate modulation of the target illuminator superimposed over a relatively low frequency pulse of the target illuminator used to disorient a target.

The driver circuit 70 is operably connected to the target illuminator 40 (the light emitting elements 42), the power source and the laser module 60 (the laser 64). The driver circuit 70 is constructed to allow operation of the target illuminator 40 in a steady state, while simultaneously operating the laser 64 in a pulsed mode such as on the order of approximately 10 cycles per second, or a continuous mode. In one configuration, the driver circuit 70 allows the separate and individual operation of the target illuminator 40 or the laser 64, as well as the combined operation, wherein either of the target illuminator or the laser can be in a continuous or pulsed mode.

The driver circuit 70 can also cooperate with the frame 22, when formed of a conductor such as aluminum, so that the frame forms a portion of the driver circuit.

Actuation of the driver circuit 70 can be accomplished by any of a variety of on-off mechanisms such as buttons, switches or levers, which can be located on the frame 22, or spaced from the frame by wireless interconnection or tethered interconnection. The driver circuit 70 can cooperate with colored bulbs or LEDs to indicate the status of the target illuminator and laser. Further, the driver circuit 70 can provide an indication of available capacity of the power source, such as batteries, by a predetermined light or flash pattern.

Figure 15:
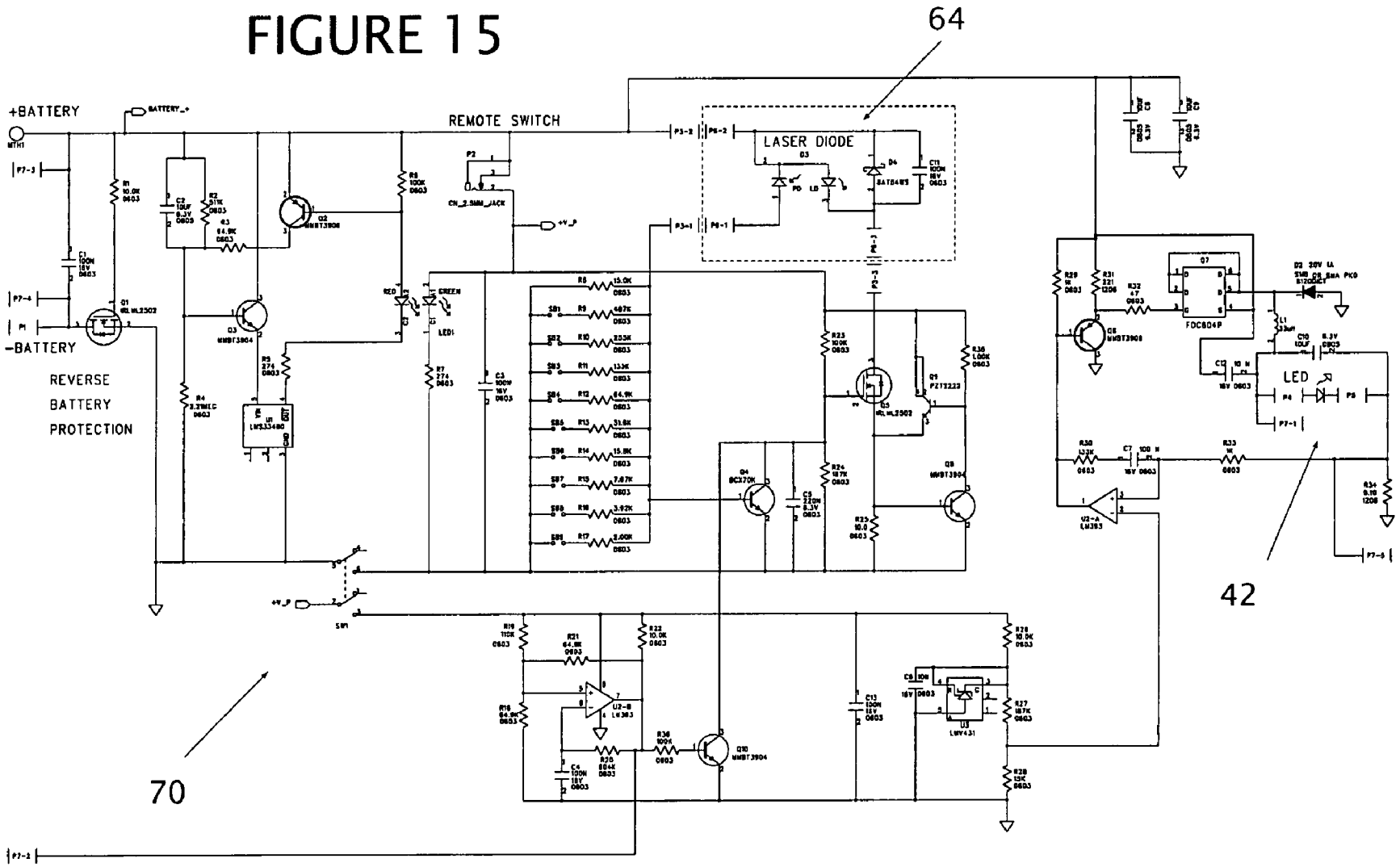
FIG. 15 is a schematic of a driver circuit for operating the target illuminator and the laser sight.
Figure 16:
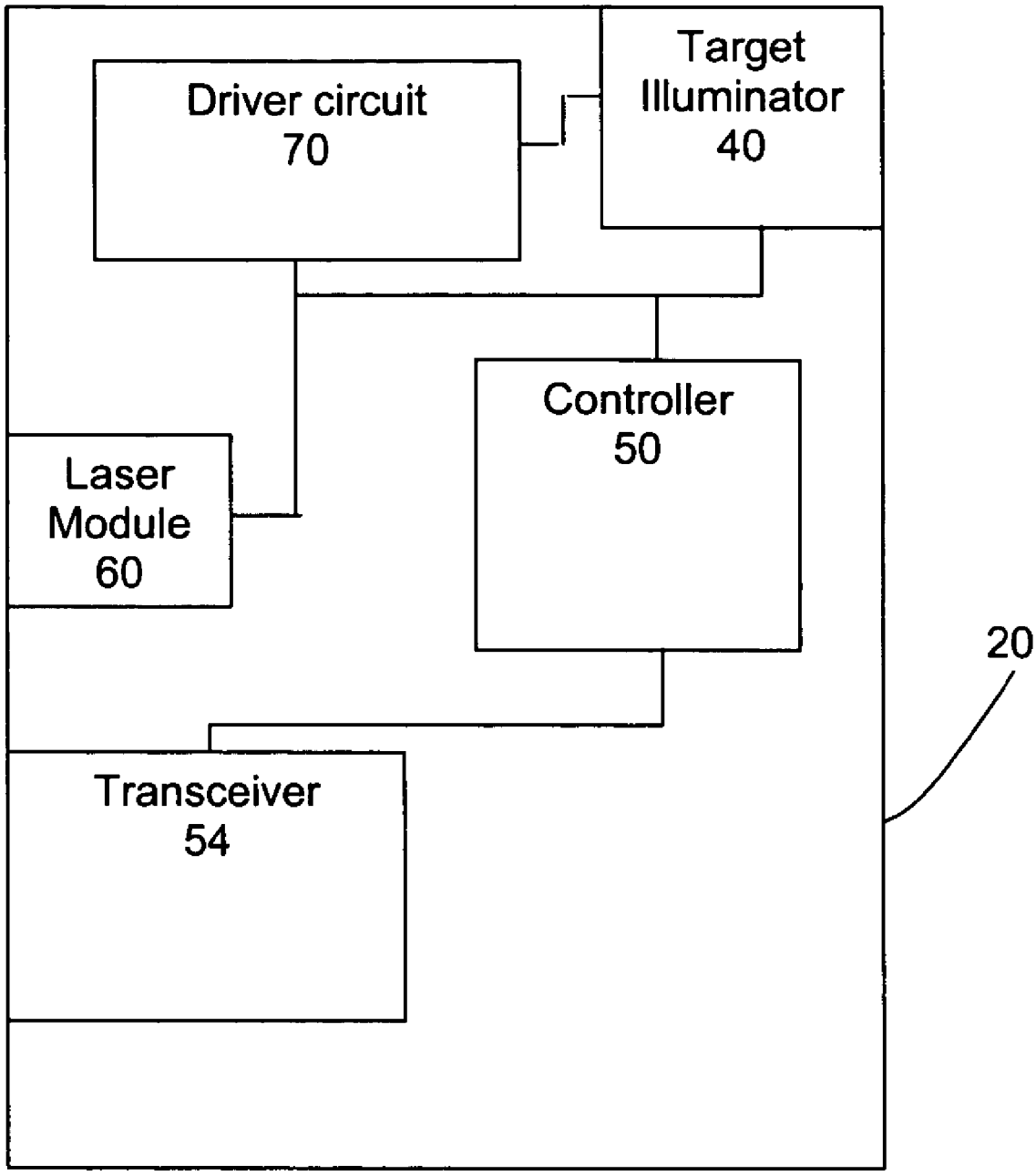
FIG. 16 is a schematic of the controller, with the driver circuit and a transceiver.
Figure 17:
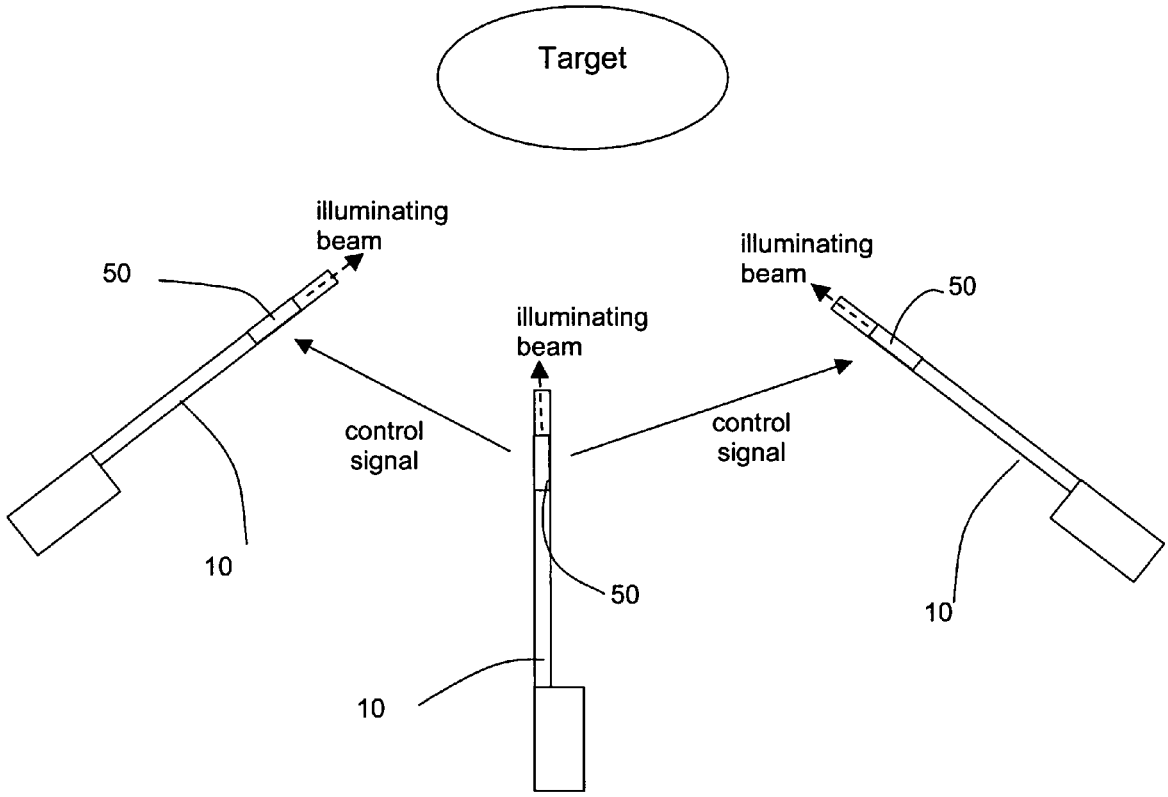
FIG. 17 is a schematic of a plurality of firearms, each firearm having a target illuminating assembly, wherein the target illuminators provide a coordinated, and disabling illumination of the target.

Referring now to FIG. 15, the driver circuit 70 for the laser 64 such as a laser diode, and the target illuminator 40, particularly the light emitting elements 42, such as an LED, is shown in schematic form. The driver circuit 70 includes a terminal for connecting the circuit to the power source, such as a battery. A second terminal provides a ground connection and a field effect transistor is connected between the second ground terminal and circuit ground to protect the driver against damage caused by reversing the polarity of the battery.

A voltage detector consisting of a transistor and a voltage detector module is connected to a red light emitting diode which is illuminated when the voltage falls below a preselected value. Preferably, feedback is provided through a transistor and an RC timing circuit to the base of the first transistor so that the light emitting diode blinks as the voltage is reduced, the rate of blinking increasing as the voltage becomes lower and finally increasing to the point where the light emitting diode is on continuously.

The laser sight laser diode has its anode connected to the battery and its cathode connected to a field effect control transistor that regulates the current through the laser diode. In one configuration, the laser diode is part of a removable module that also includes a detector diode optically coupled to the laser diode for measuring the intensity of the light output of the laser diode. The detector diode is connected to a switchable bank of resistors which are connectable in parallel by a purality of jumpers which can be formed as solder bridges on a printed circuit board for setting the current through the laser diode and therefore its nominal intensity.

The detector diode is connected in a feedback circuit by way of a controlling transistor to the gate of the field effect transistor. The collector of the controlling transistor is connected to the output of a pulse generator which preferably generates pulses at a rate of about 10 hertz and a duty cycle of about 50%. The feedback circuit insures that as the battery voltage decreases and/or the output of the laser diode 64 decreases over time, the light output of the laser diode 64 remains substantially constant.

A problem associated with pulsing a laser diode 64 on and off is that the battery voltage is affected by the relatively large current drawn by the laser diode. This causes the light emitting element 42 in the target illuminator 40 (target illuminator LED) to flicker at a rate corresponding to the flash rate of the laser diode. An anti-flicker transistor and a load element are connected in parallel with the laser sight diode 64 and controlled by a transistor which operates as an inverter so that when the laser sight diode is off, the load element is connected and the power drawn from the battery is essentially constant and a flicker of the target illuminator LED 42 caused by the flashing of the laser diode is substantially eliminated. Thus, the driver circuit 70 provides substantially constant illumination by the target illuminator 40, independent of the status (operating state) of the laser sight, and particularly the laser diode 64. That is, the driver circuit 70 causes a steady illumination of the target illuminator 40 substantially independent of the power draw of the laser sight.

The current to the target illuminator LED 42 is maintained substantially constant by a field effect transistor configured as a constant current source connected in series with the target illuminator LED and driven by a driver transistor. The driver transistor is in turn driven by a comparator coupled in feedback circuit relationship with the target illuminator LED 42 to maintain the current through the target illuminator LED essentially constant. In this manner, as the battery voltage decreases, the current does not change and the light output of the light emitting element 42 of the target illuminator (the target illuminator LED) remains essentially constant.

It is further contemplated the driver circuit 70 can include a timing or pulsing component for allowing a selective on/off of the target illuminator 40 and specifically the target illuminating element (LED) 42. That is, the target illuminator 40 can be flashed or pulsed at a variety of rates. For example, one of the rates of illumination for the target illuminator 40 can be selected to disorient or daze a human target. Typical illumination rates for such disorientation are approximately 4 Hz to approximately 60 Hz. Such capacity for pulsing or flashing the target illuminator 40 can be incorporated within the driver circuit 70, or through the controller 50.

In addition, the controller 50 and/or the driver circuit 70 can be programmed to synchronize flashing of the target illuminator 40 in a predetermined manner with the target illuminator of a second target illuminating assembly 20. Thus, a plurality of target illuminating assemblies 20 can be synchronized to flash or pulse the respective target illuminators 40 at a common time or a given sequence or pattern. For example, the controllers 50 (or the driver circuits 70) can be programmed to allow for alternative flashing patterns such as sequentially, random or sub groupings.

Coordination of a plurality of target illuminating assemblies 20 can also be provided by each assembly having a designated master or slave setting for the controller 50. In the master setting or mode, the controller 50 will send signals to any other assembly 20 within the vicinity, wherein the control signals provide at least one of a flash rate, timing or sequence for the corresponding target illuminators 40. The slave setting or mode of the controller 50 will require the associated controller to follow or respond to control signals from a master controller. Thus, the slaved target illuminating assembly 20 will effectively lock on to the illumination pattern of the master target illuminating assembly.

The control signals from the transceiver 54 can be in the form of superimposed pulsations or modulations of the target illuminator 40. Alternatively, the control signals between assemblies 20 can be any of a form of commercially available wireless protocols, including infrared, ultrasonic or microwave. The transceiver 54 is selected to be compatible with the respective control signal.

It is further contemplated that in the coordination of target illuminating assemblies 20 through a relatively high modulation rate superimposed over the low-frequency disorienting pulse of the target illuminators, the transmitted data can include a code corresponding to a serial number of the assembly 20 and the controllers 50 are programmed to designate the highest, the lowest or some other predetermined serial number to become the master assembly. The instructions can be received from a peer transceiver, wherein the peer transceiver can then assume a master or slave relation to the given assembly 20. The remaining assemblies 20 assume a slave state and the master assembly 29 communicates to the slaved assemblies in the vicinity as to the particular pulse or flash sequencing of the target illuminator 40 or the laser sight.

In operation, the frame 22 is slid over the terminal ends of the magazine tube 12 and the barrel 14, so that the clamping sleeve 23 receives the magazine tube, and the barrel-receiving channel receives the barrel. Upon locating the desired length, typically the entire length of the frame 22, along a length of the magazine tube 12 and the barrel 14, the clamping flanges 30 are drawn together so as to substantially fix the frame relative to the firearm 10.

As the clamping sleeve 23 of the frame 22 encircles and clamps about the magazine tube 12 and the barrel receiving channel 29 encompasses the diameter of the barrel 14, the frame functions as a stabilizing member fixing the relative positions of the magazine tube and the barrel. As the frame 22 can be cooperatively engaged with the magazine tube 12 adjacent or proximal to the free end of the magazine tube and can retain the barrel 14, the rigidity of the magazine tube and barrel assembly can be substantially increased.

In one configuration, the frame 22 locates the target illuminator 40 within the horizontal footprint of the firearm 10. That is, the target illuminator 40 is located between the top of the barrel 14 and the bottom of the magazine tube 12.

In a further configuration, the frame 22 locates the laser module 60 within the horizontal footprint of the firearm 10. That is, the laser module 60 is located between the top of the barrel 14 and the bottom of the magazine tube 12.

In addition, as at least a majority of the target illuminator 40, and particularly the reflector 44 is disposed within the illuminator recess 27, the frame 22 protects the target illuminator thereby reducing unintended contact of the target illuminator with external structures.

As the integrated target illuminator and clamp 20 are located about an exterior of the magazine tube 12, the capacity of the magazine tube is not reduced.

With respect to operation of the integrated target illuminating assembly 20 and integrated clamp, the controller 50 can be selected to pulse the target illuminator 40, (and particularly the light emitting element 42) at a frequency which contributes to a disorientation disabling or temporary blinding of a human target. It is contemplated to flashing a solid-state LED light, such as the light emitting element 42 in the target illuminator 40, at a frequency between approximately 4 Hz and 60 Hz. That is, upon viewing the pulsing target illuminator 40, the human response is a temporary blindness or disorientation. Thus, an individual assembly 20 can assist a user in disabling a human target.

While the invention has been described in connection with a presently preferred embodiment, those skilled in the art will recognize that modifications and changes can be made therein without departing from the true spirit and scope of the invention, which accordingly is intended to be defined by the appended claims.

The invention claimed is:

1. A target illuminator assembly for a firearm having a barrel, the assembly comprising:

a frame cooperatively engaging the barrel;

a target illuminator connected to the frame, the target illuminator including light emitting element; and a controller operably connected to the target illuminator, the controller pulsing the target illuminator, wherein the controller includes a master mode and a slave mode wherein the controller is capable of communication with a second controller on a second firearm.

2. The target illuminator assembly of claim 1, wherein the light emitting element is a laser.

3. The target illuminator assembly of claim 1, wherein the controller includes a driver circuit.

4. The target illuminator assembly of claim 1, wherein the frame includes a clamping sleeve for cooperatively engaging the barrel.

5. The target illuminator assembly of claim 1, light emitting element is a solid state emitter.

6. The target illuminator assembly of claim 1, wherein the controller includes a driver circuit, the driver circuit selected to provide a simultaneous constant target illumination and pulsed coherent light.

7. The target illuminator assembly of claim 1, wherein the frame includes a clamping sleeve for cooperatively engaging the barrel, the clamping sleeve including a pair of spaced clamping flanges for varying a circumference of the clamping sleeve.

8. The target illuminator assembly of claim 1, wherein the frame is electrically conductive and electrically couples a battery compartment to the controller.

9. The target illuminator assembly of claim 1, wherein the controller includes a driver circuit connected to the target illuminator and a laser sight, the driver circuit providing substantially constant illumination of the target illuminator independent of a power draw of the laser sight.

10. A target illuminator assembly comprising:

a frame cooperatively engaging the barrel;

a target illuminator connected to the frame, the target illuminator including light emitting element; and a controller operably connected to the target illuminator, the controller pulsing the target illuminator;

a second frame cooperatively engaging a second barrel;

a second target illuminator connected to the second frame, the second target illuminator including second light emitting element; and a second controller operably connected to the second target illuminator, the second controller in operable communication with the controller.

11. The target illuminator assembly of claim 10, wherein the target illuminator includes a laser.

12. The target illuminator assembly of claim 10, wherein the controller includes a driver circuit.

13. The target illuminator assembly of claim 10, wherein the frame includes a clamping sleeve for cooperatively engaging the barrel.

14. The target illuminator assembly of claim 10, target illuminator is a solid state emitter.

15. The target illuminator assembly of claim 10, wherein the controller includes a driver circuit, the driver circuit selected to provide a simultaneous constant target illumination and pulsed coherent light.

16. The target illuminator assembly of claim 10, wherein the frame includes a clamping sleeve for cooperatively engaging the barrel, the clamping sleeve including a pair of spaced clamping flanges for varying a circumference of the clamping sleeve.

17. The target illuminator assembly of claim 10, wherein the frame is electrically conductive and electrically couples a battery compartment to the controller.

18. The target illuminator assembly of claim 10, wherein the controller includes a driver circuit connected to the target illuminator and a laser sight, the driver circuit providing substantially constant illumination of the target illuminator independent of a power draw of the laser sight.

* * * * *

UNITED STATES PATENT AND TRADEMARK OFFICE

CERTIFICATE OF CORRECTION

PATENT NO. : 7,584,569 B2
APPLICATION NO. : 11/207418
DATED : September 8, 2009
INVENTOR(S) : Kallio et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 511 days.

Signed and Sealed this

Fourteenth Day of September, 2010

David J. Kappos

David J. Kappos
*Director of the United States Patent and Trademark Office*